US010012472B2

(12) United States Patent
Gohlke

(10) Patent No.: US 10,012,472 B2
(45) Date of Patent: Jul. 3, 2018

(54) MOUNT FOR FIBER OPTIC CROSSBOW SIGHT

(71) Applicant: Robert Gohlke, San Antonio, TX (US)

(72) Inventor: Robert Gohlke, San Antonio, TX (US)

( * ) Notice: Subject to any disclaimer, the term of this patent is extended or adjusted under 35 U.S.C. 154(b) by 121 days.

(21) Appl. No.: 15/272,818

(22) Filed: Sep. 22, 2016

(65) Prior Publication Data

US 2018/0080737 A1 Mar. 22, 2018

(51) Int. Cl.
*F41G 1/467* (2006.01)
*F41B 5/12* (2006.01)

(52) U.S. Cl.
CPC ..... *F41G 1/467* (2013.01); *F41B 5/12* (2013.01)

(58) Field of Classification Search
CPC ..... F41G 1/467; F41B 5/12
USPC ..... 33/265
See application file for complete search history.

(56) References Cited

U.S. PATENT DOCUMENTS 2,814,284 A * 11/1957 Sileo ..... F41B 5/12 124/25
2,842,114 A * 7/1958 Duncan ..... F41B 5/12 124/25
3,922,795 A * 12/1975 Bettencourt ..... F41G 1/08 33/265
7,574,810 B1 * 8/2009 LoRocco ..... F41G 1/30 124/87
2003/0208916 A1 * 11/2003 Rager ..... F41G 1/467 33/265
2005/0150119 A1 * 7/2005 Ellig ..... F41G 1/467 33/265
2007/0028467 A1 * 2/2007 Bradley ..... F41G 1/467 33/265
2009/0000134 A1 * 1/2009 Kurtzhals ..... F41G 1/467 33/265
2010/0024228 A1 * 2/2010 Gibbs ..... F41G 1/467 33/265
2011/0214304 A1 * 9/2011 Priebe ..... F41G 1/467 33/265
2012/0180329 A1 * 7/2012 Priebe ..... F41G 1/01 33/265
2013/0247399 A1 * 9/2013 Evans ..... F41G 1/467 33/265
2016/0025456 A1 * 1/2016 Hamm ..... F41G 1/467 33/265
2017/0030680 A1 * 2/2017 Heidemann ..... F41G 1/467
2017/0363389 A1 * 12/2017 Lohan ..... F41G 1/467
2018/0045488 A1 * 2/2018 Hamm ..... F41G 1/467

* cited by examiner

*Primary Examiner* — G. Bradley Bennett

(57) ABSTRACT

A mount for a crossbow adjustable multiple fiber optic sight with a sight housing and having a plurality of adjustable sight pins. A graduated elevation scale is secured to the sight housing and a graduated slide scale with adjustable clamps is secured to the graduated elevation scale. A mounting bracket having a first base mount is mounted on a cross bow riser and a second base mount is connected to and extends upwardly from the base mount. A bracket fastener is attached to the vertical base mount and has an upper clamping surface and a second horizontal bracket fastener is positioned below the first horizontal bracket panel and including a lower clamping surface. An adjuster screw clamps the two bracket fasteners together so that they are able to clamp onto the graduated slide scale and hold it in an adjusted position with the adjusting screw.

11 Claims, 6 Drawing Sheets

MOUNT FOR FIBER OPTIC CROSSBOW SIGHT

CROSS-REFERENCE TO RELATED APPLICATIONS

NA

STATEMENTS REGARDING FEDERALLY SPONSORED RESEARCH OR DEVELOPMENT

NA

REFERENCE TO A MICROFICHE APPENDIX

NA

BACKGROUND OF THE INVENTION

1. Field of the Invention

This invention relates to a mount or adapter for fiber optic sights for crossbows, and in particular to a fiber optic sight mount that allows the hunter to use multi pin, fiber optic pin sites for almost any crossbow.

2. Description of the Related Art

Compound bow hunting is popular today. In many regions, compound bow season is longer and more plentiful. A compound bow strengthens different skills when the shooter wants some good exercise while satisfying the urge to improve one's target-directed motor skills. Camouflaged, crouched down, and blending in with nature, the swift silence of a compound bow and arrow doesn't disrupt the creatures around you the way echoing gunfire does. The compound bow method requires more skill on the hunter's part and is consider a fairer way to hunt game. In many states, challenged (physically) hunters must use open sites on their crossbow during bow season and scopes are not allowed.

Traditionally crossbows were not allowed during the typically expanded bow hunting season. A crossbow was considered to be not much different than a gun—they are both locked and loaded. Hunters are able to become more proficient with a crossbow much quicker than with its low bow counterparts. As a result, someone who has spent months developing strength and patience with a compound or recurve bow can be in the woods with another hunter who bought a crossbow a week before the season starts. Many states still restrict the use of crossbows during bow hunting season and you must use open sites and cannot use a scope. Some states require a Disabled Archer Permit for a hunter to use a crossbow during bow hunting season. Crossbows allow small-frame shooters like kids and women to do bow hunting. Crossbows can be used to keep mature bow hunters from being forced to retire from bow hunting as their upper bodies strength declines. The shorter arrows pushed by the crossbow's abbreviated power stroke, cannot match the energy stored by longer arrows launched from compound bows via longer power strokes—even if the crossbow's draw weight is four times that of the average compound.

Pin sights have been commonly used on compound bows for several years. A compound bow sight is a device that's mounted on the riser of a compound bow that helps you to aim your arrow. The bow sight simply helps tell you where your projectile is pointed. Though it is possible to shoot your compound bow without a sight, doing so is difficult—especially at longer ranges. As such, most modern compound bows are outfitted with some kind of sight. Used in conjunction with a peep-sight or kisser-button and a quality arrow rest, even novice archers can be surprisingly accurate.

A fixed-pin sight is a common type of sight, and a popular choice of compound bow hunters. A fixed-pin sight usually has 3 to 5 individual pins, which can each be set for a particular known distance. The top pin is for the closest distance and the lower pins are for longer distances. Once set, the pins are tightened and remain "fixed" in position during use. Setting up and adjusting a fixed-pin sight requires some trial and error testing. Currently the choice of fiber optic pins on a crossbow is very limited and expensive.

Hunters typically set their fixed-pins for easy-to-remember distances, usually in 5 or 10 yard increments. Once the pins are set, shooting known distances is a snap. If your target is 30 yards away, you simply sight the bow by placing your pre-set 30-yard pin on the intended target—then shoot. The sight does all the compensation for the change in the arrow's trajectory.

If the pins are set for 20, 30, & 40 yards (common setup), a fixed-pin shooter must learn to compensate as necessary for intermediate distances for which no pin is set. If your target is 25 yards away, a 20-yard pin will shoot a bit too low—a 30-yard pin too high. So a fixed-pin shooter must learn to split the difference and hold somewhere between the pins, known as "gap-shooting".

Scopes have been previously commonly used on crossbows. But because of the design of a crossbow, one cannot simply take any pin sight for a long or compound bow and place it on a crossbow.

One cannot simply take a sight for a long bow and mount it on a cross bow. A cross bow presented problems for mounting a sight. An object of this invention is to overcome the problems and provide a mount that can be installed on most cross bows and still be adjustable to obtain the optimum sight with fiber optic sights.

An example of a crossbow sights is shown in U.S. published patent application No. US 2010/0281751 published Nov. 11, 2010, Edward J. Humpert, inventor, Ser. No. 12/777,484, filed May 11, 2010.

Another example is from MFO that sells a crossbow pin and peep sight.

Another example is from Excalibur that sells a fiber optic front sight and peep rear sight for a crossbow.

BRIEF SUMMARY OF THE INVENTION

The invention relates to a mount or adapter that can combine adjustable fiber optic pin sites only available to compound bows to crossbows. The adapter is a device that connects pieces of equipment that cannot be connected directly. Currently no known device in the market can do this. The mount or adapter offers physically challenged hunters the ability to customize fiber optic pin sights to their crossbows and all hunters to get that true bow experience with a crossbow.

A mount is provided for a crossbow adjustable multiple fiber optic sight, comprising an adjustable fiber optic sight with a sight housing and having a plurality of adjustable sight pins and a graduated elevation scale secured to the sight housing. A graduated slide scale with adjustable clamps is secured to the graduated elevation scale. A mounting bracket is provided having a first base mount for mounting on a cross bow riser and a second base mount connected to and extending upwardly from the base mount.

A bracket fastener is attached to the vertical base mount and has an upper clamping surface. A second horizontal bracket fastener is positioned below the first horizontal bracket panel and including a lower clamping surface; and an adjuster screw clamping the two bracket fasteners together is provided so that they are able to clamp onto the graduated slide scale and hold it in an adjusted position with the adjusting screw.

DETAILED DESCRIPTION OF THE INVENTION

Figure 1:
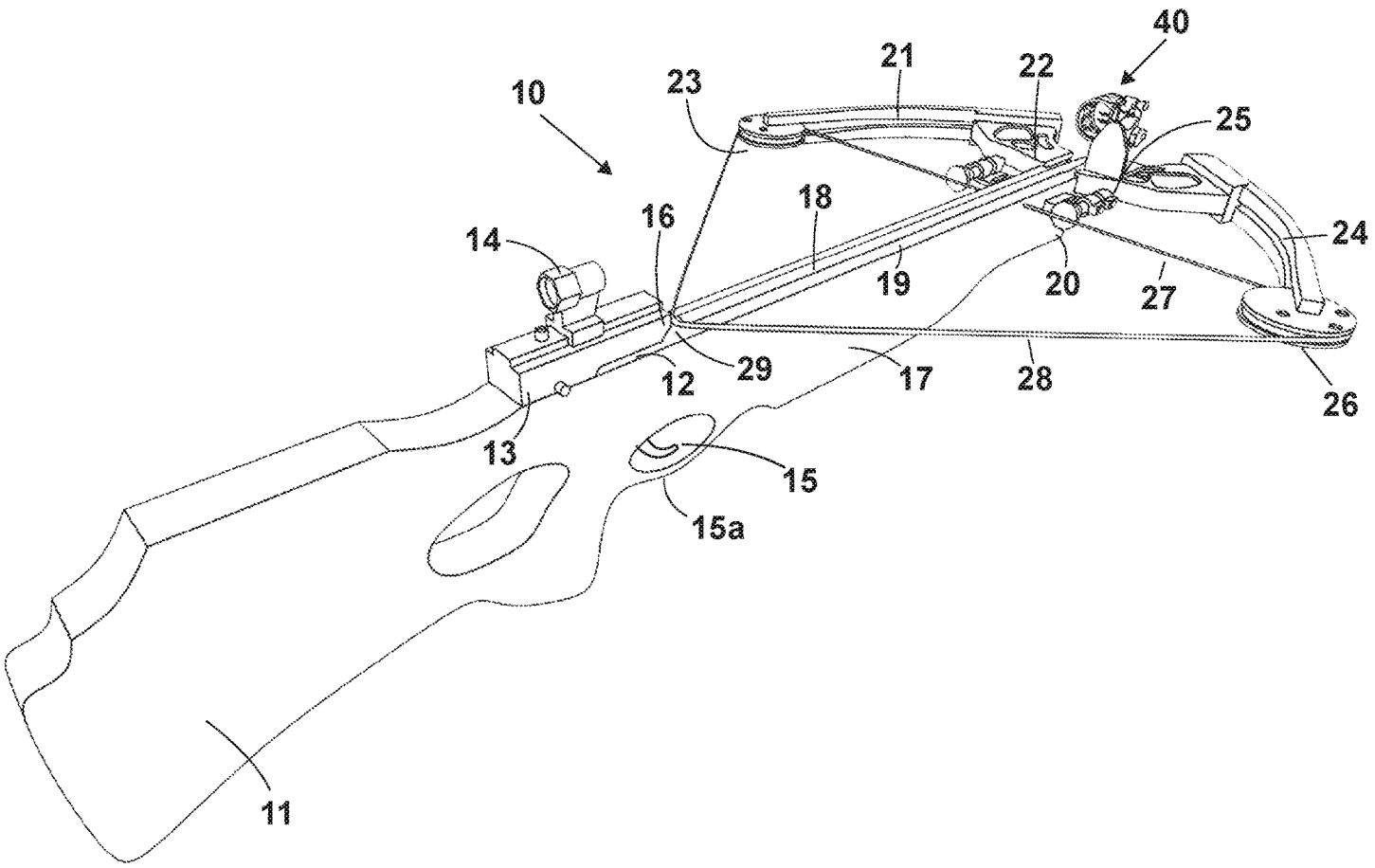
FIG. 1 is perspective view of a crossbow.

Referring to FIG. 1 of the drawing there is shown a standard crossbow 10 with an adjustable multiple fiber optic sight. Examples of such standard crossbows manufactured by TENPOINT crossbows, EXCALIBER crossbows, PSE crossbows, BEAR crossbows and HORTON crossbows.

The crossbow 10 includes a stock 11 which is typically made of wood but may also be made of plastic. The stock includes a latch 12 and a sight bridge 13. A peep sight 14 is mounted on top of the sight bridge 13. The peep sight 14 typically is an optical sight but also a pin sight may be used. The crossbow 10 includes a trigger 15 and trigger guard 15*a*. An arrow retention spring 16 is mounted on the crossbow. The crossbow 10 includes a fore-grip 17. It includes a barrel 20 having a barrel top surface 19 and a flat grove or arrow track 18.

The crossbow includes a left limb 21 that is attached to a left riser 22. The left limp 21 includes a left cam or wheel 23. A right limb 24 is connected to the right riser 25. A right cam or wheel 26 is mounted on the right limb 24 at its end. The crossbow includes a cable 27 that is connected around the cams or wheels and a string portion 28. A serving 29 of the string is positioned to connect with the arrow head.

The standard fiber optic sight 40 includes a sight housing 40*a*. Examples of such fiber optic sights are manufactured by TROPHY RIDGE, SAS, 3PIN, TRU-GLO, BARNETT, STRYKER and EXCALIBER brand fiber optic sights. Examples of TROPHY RIDGE brand sights are a Volt 5-Pin Bow Sight, a Joker 4-Pin Bow Sight, a Joker 3-Pin Bow Sight, a Hit-Man 3-Pin Bow Sight and a Mist 3-Pin Bow Sight Referring to FIG. 2 there is shown the adjustable multiple fiber optic sight of the invention mounted on the right riser.

Figure 2:
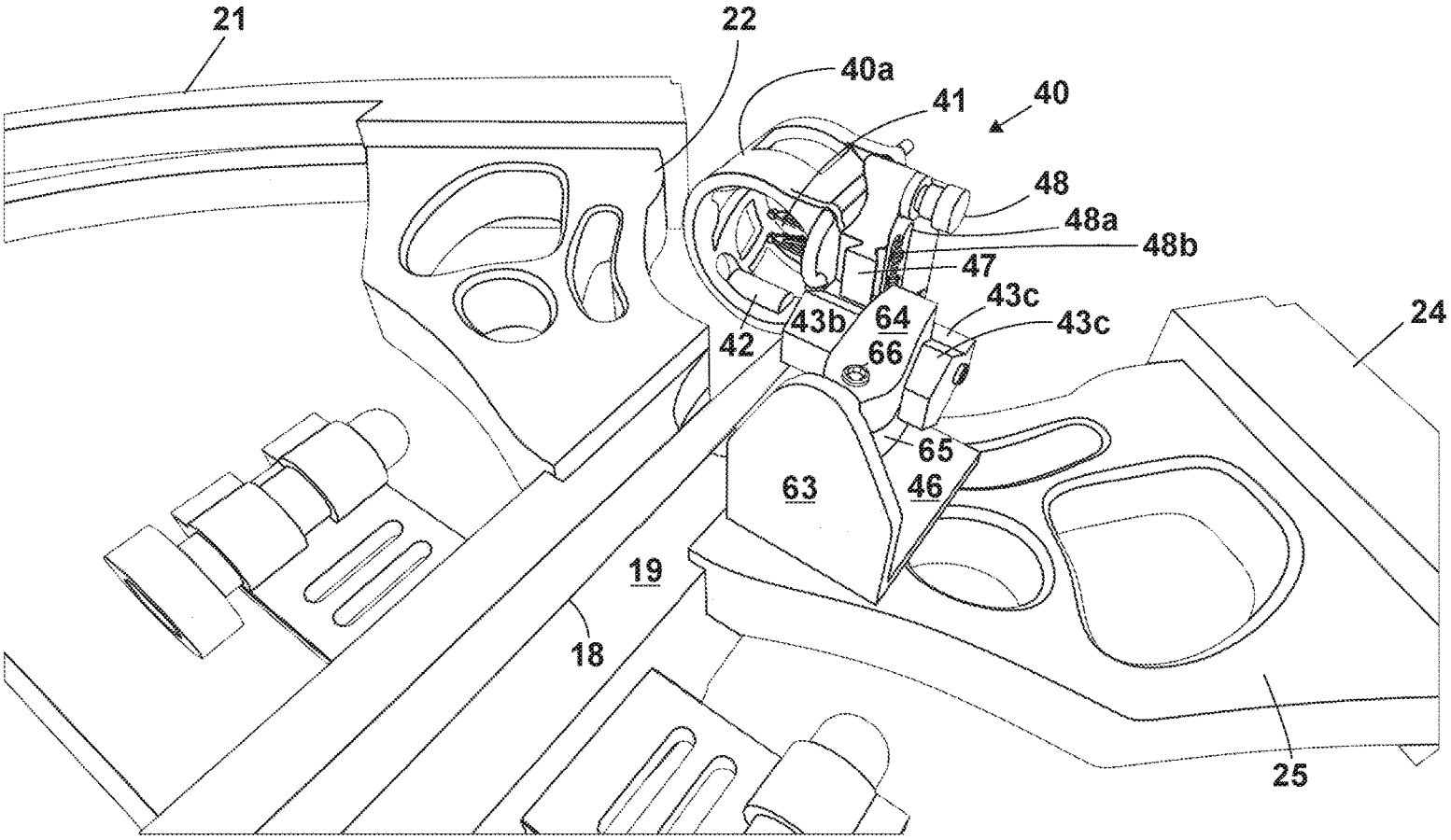
FIG. 2 is and enlarged view of the fixed pin sight and mount on a crossbow.
Figure 3:
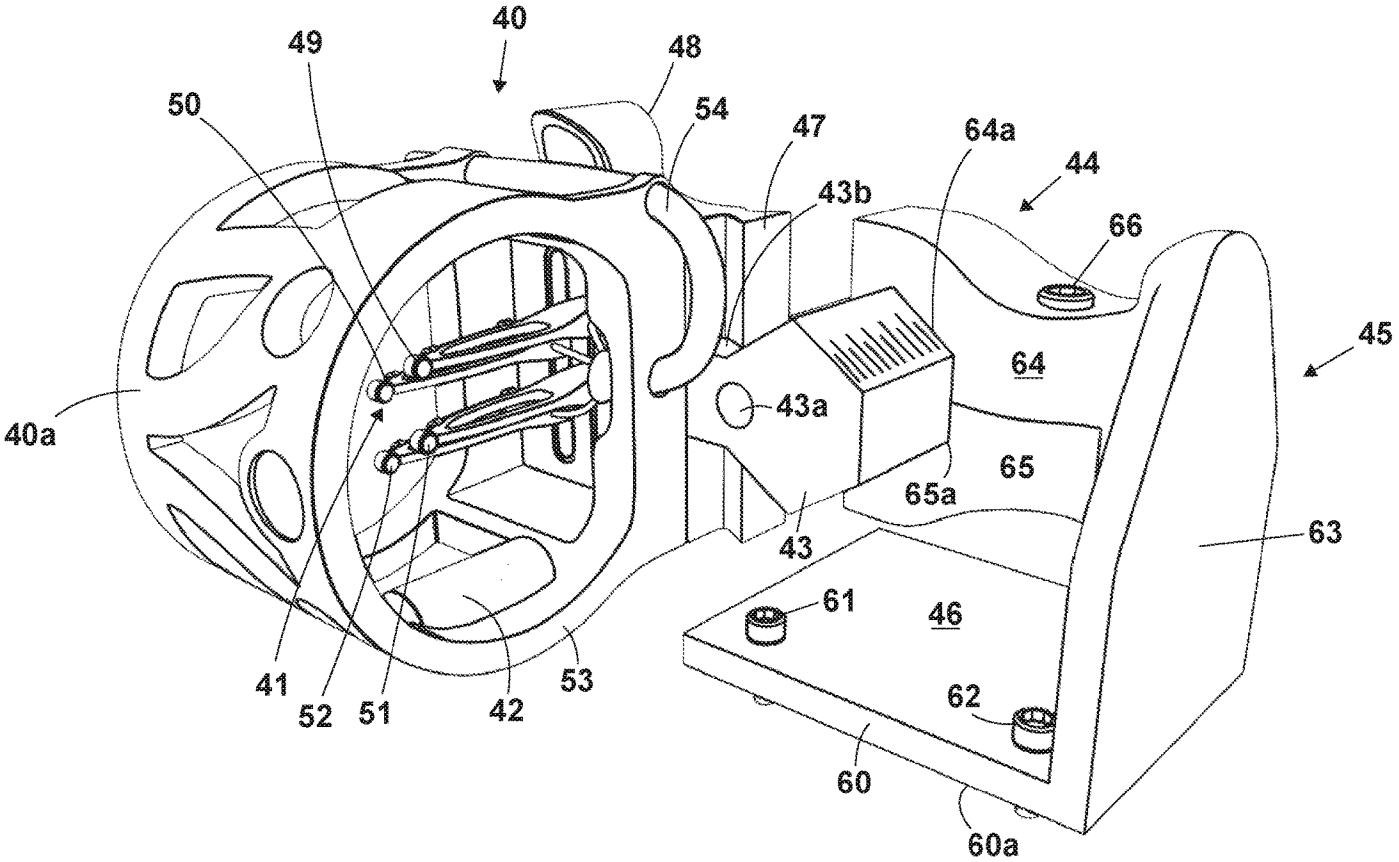
FIG. 3 is perspective view of the fixed pin sight and mount.

Referring to FIGS. 2 and 3 the adjustable multiple fiber optic sight includes the sight housing 40 with pin adjusters 41. A horizontal bubble sight 42 is provided to level the crossbow. A graduated scale slide member 43 allows for a first range of adjustment to properly position and align the sight housing 40. The graduated scale slide member 43 is mounted in a graduated scale bracket clamp fastener 44. The bracket fastener 45 includes a mounting horizontal base mount bracket 46. The housing 40 includes a generally vertical graduated elevation scale slide 47 that is adjustably gripped by the two clamps 43*b* and 43*c* and adjusting screw 43*a* to provide a second range of adjustment. A third axis adjustment mount 48 having slide slots 48*a* and adjusting screw 48*b*, shown in FIG. 2, is provided to adjust and set the vertical position of the sight pins. The sight housing includes a first sight pin 49, a second sight pin 50 and a third sight pin 51 and a fourth sight pin 52 adjustably mounted on the mount 48 on the slide slots with set screws. The sight housing 40 includes an aiming ring 53 as shown in FIG. 3. The sight pins 49, 50, 51 and 52 are connected to a fiber optic cable 54 to provide light to the pins and make them more visible.

Figure 5:
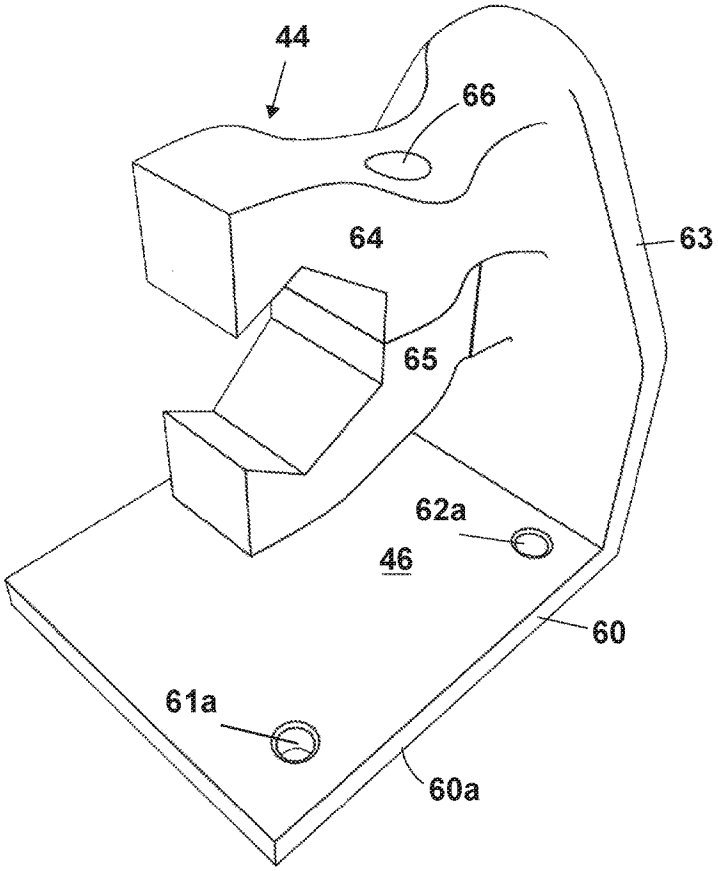
FIG. 5 is a perspective view of the mount.
Figure 4:
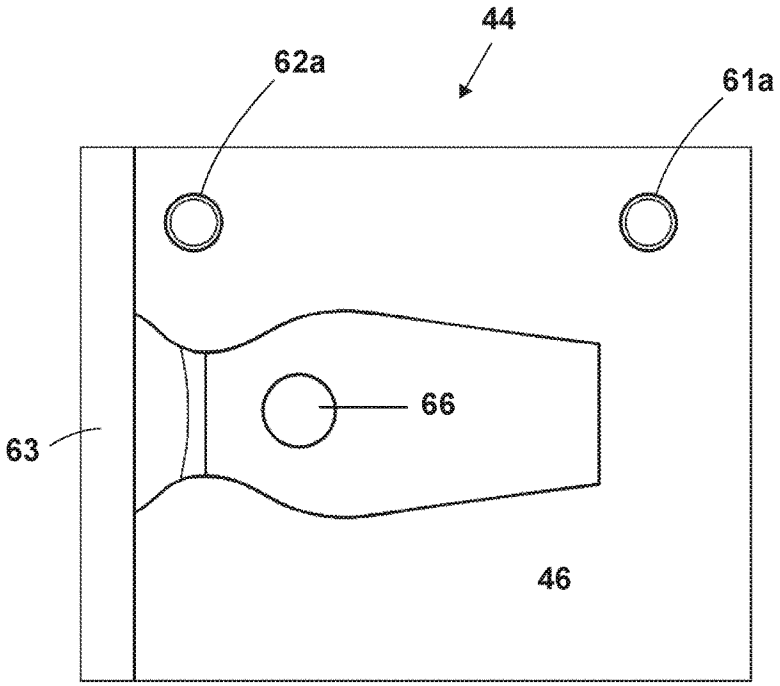
FIG. 4 is a top view of the mount.
Figure 6:
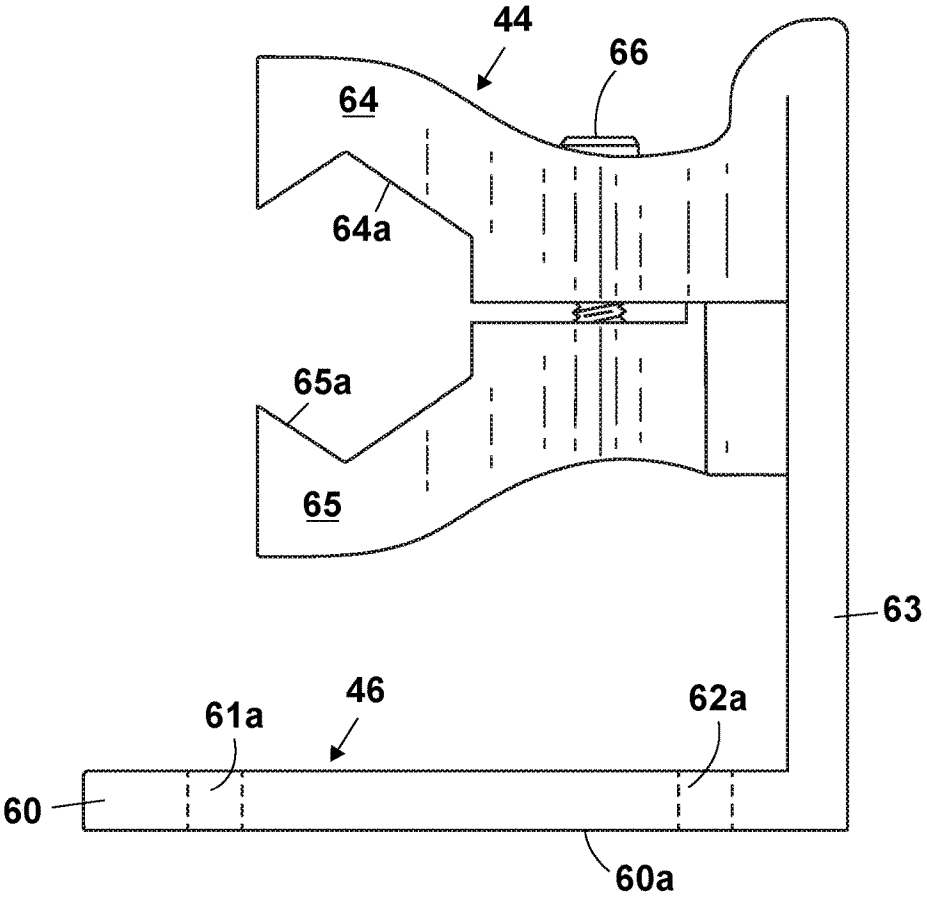
FIG. 6 is side view of a two-piece claim mount.

Referring to FIGS. 4 and 5 the bracket 44 includes a generally horizontal first base mount 60 having a first lower flat surface 60*a*. The orientation of the first base mount will depend on the orientation of the riser surface it is mounted on. A mounting screw 61 and a mounting screw 62 extend through round apertures 61*a* and 62*b* in the horizontal base mount 60 to screw the base mount 60 onto threaded openings in the riser 25. The round apertures 61*a* and 61*b* can be drilled to fit a particular cross bow. This enables the horizontal base mount 60 to be positioned so it properly aligns the sight housing 40 and not interfere with the operation of the crossbow. The round apertures 61*a* and 61*b* may also be extended as slots to allow additional adjustment in order to adapt the mount to different crossbows. Another fastening means such as adhesive or a clamp might be used to securely mount it on the crossbow. This provides a wide fourth range of adjustment in addition to the other two ranges of adjustments to properly position and sight the sight housing 40.

A second vertical base mount 63 is connected to and extends upwardly from the horizontal base mount 60 at a right angle. The orientation of the second base mount will also depend on the orientation of the riser surface it is mounted on. A first horizontal bracket fastener 64 is attached to the vertical base mount 63 at a right angle and includes an upper clamping surface 64*a*. A separate second horizontal bracket fastener 65 is positioned below the first horizontal bracket panel 64 and includes a lower clamping surface 65*a*. An adjuster screw 66 clamps the two bracket fasteners 64 and 65 together so that they are able to clamp onto the graduated slide scale 43 and hold it in an adjusted position with the adjusting screw. This mount allows the crossbow hinter many choices for fiber optic pins to use that are available on the market today.

Figure 7:
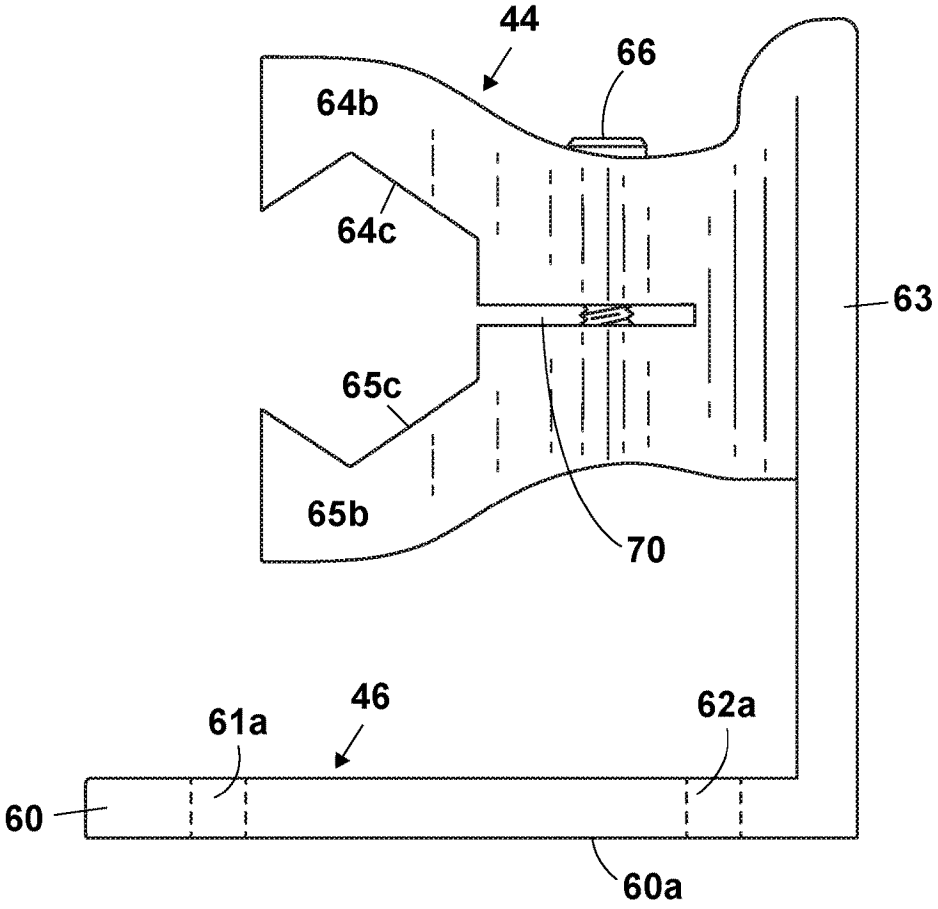
FIG. 7 is a side view of a one-piece clamp mount

Referring to FIG. 7 a modified version of the bracket is provided that shows a first horizontal bracket 64*b* attached to the vertical base mount 63 and including a clamping surface 64*c*. A second horizontal bracket fastener 65*b* is also secured to the vertical base mount 63 and includes a slit or opening 70 that may be squeezed and closed using the adjusting screw 66 to clamp the clamping surfaces 64*c* and 65*c* on the graduated scale 43.

The compact size of the bracket 44 allows it to be mounted onto the crossbow 10. The risers on crossbows vary. Applicant's design allows it to be placed on almost any cross bow, unlike fixed designs that are integrated into crossbow. The design of the base mounts 60 and 63 allow adjustment of the sight 40 to accurately sight it in and rigidly and reliably hold it in place. The bracket 44 may be made of aluminum because it is strong, lightweight and inexpensive.

The mount 44 allows for adjusting and sighting for various crossbows. This can be accomplished by positioning of the holes 61*a* and 62*a*. Although screws are used to attach the mount 44 to the riser, other suitable means such as clamps or adhesives could also be used. The bracket 44 includes adjustments so that it can be mounted on almost any cross bow.

Once it is mounted it then must be sighted in by adjusting the graduated scale 3 and graduated elevation scale 47. It is also possible to adjust the positions of the sight pins 49, 50 51 and 52 to provide a third axis of adjustment.

Because of the compact design and rigidity of the mount, the sighting will hold after adjusting. It adds very little weight to the crossbow because of it compact and light-weight design.

Some of the advantages of the invention are that it is fully adjustable so it can fit almost any crossbow. It can be used right and left handed and you can load bolts from left or right. It fits many types of crossbows and can use many pin sights. It is inexpensive to manufacture so it is easily affordable.

The above-listed sections and included information are not exhaustive and are only exemplary or the invention. The particular sections and included information in a particular embodiment may depend upon the particular implementation and the included devices and resources. Although a system and method according to the present invention have been described in connection with the preferred embodiments, it is not intended to be limited to the specific form set forth herein, but, on the contrary, it is intended to cover such alternatives, modifications, and equivalents, as can be reasonably included within the spirit and scope of the invention as defined by the appended claims.

I claim:

1. A mount for a crossbow adjustable multiple fiber optic sight, comprising:

an adjustable fiber optic sight with a sight housing and having a plurality of sight pins positioned to represent distances from the crossbow;

a graduated elevation scale secured to the sight housing to provide adjustment;

a graduated slide scale having adjustable clamps secured to the graduated elevation scale to allow vertical adjustment of the graduated elevation scale to align the adjustable fiber optic sight for aiming the crossbow;

a mounting bracket having a first base mount for securing on a cross bow riser at a location on the crossbow that aligns the adjustable fiber optic sight for aiming the crossbow;

a second base mount connected to and extending from the base mount;

a bracket fastener attached to the second base mount and having an upper clamping surface;

a second horizontal bracket fastener is positioned below the first bracket panel and including a lower clamping surface;

an adjuster screw clamping the two bracket fasteners together so that they are able to clamp onto the graduated slide scale and hold it in an adjustable position with the adjusting screw to align the fiber optic sight for aiming the crossbow; and a peep sight for mounting on a crossbow sight bridge for sighting on the sighting pins.

2. The mount of claim 1, wherein:

the base mount for mounting on a cross bow riser is generally horizontal.

3. The mount of claim 1, wherein:

the base mount has a lower flat mounting surface.

4. The mount of claim 1, wherein:

The base mount has a lower flat mounting surface with at least one opening in the base mount for proper positioning of the base mount on the cross bow.

5. The mount of claim 1, wherein:

the base mount has a lower flat mounting surface with at least one elongated slot opening in the base mount for allowing adjustment of the base amount on the crossbow to position the fiber optic sight.

6. The mount of claim 1, wherein:

the base mount has a lower flat mounting surface with at least one opening in the base mount for proper positioning of the base mount.

7. The mount of claim 1, wherein:

The base mount for mounting the base mount for mounting on a cross bow riser is generally vertically oriented.

8. The mount of claim 1, wherein:

The second bracket fastener is secured to and extends upward from the first base mount.

9. The mount of claim 1, wherein:

A pin sight is provided for mounting on a crossbow sight for sighting on the sighting pins.

10. The mount of claim 1, wherein:

the graduated elevation scale secured to the sight housing for adjusting vertically.

11. A mount for a crossbow adjustable multiple fiber optic sight, comprising:

an adjustable fiber optic sight with a sight housing and having a plurality of adjustable sight pins;

a vertical graduated elevation scale secured to the sight housing;

a graduated slide scale with adjustable clamps secured to the graduated elevation scale to allow adjustment of the graduated elevation scale to align the adjustable fiber optic sight for aiming the crossbow;

a horizontal mounting bracket having a first base mount and mounting openings for mounting on a cross bow riser at a location on the crossbow that aligns the adjustable fiber optic sight for aiming the crossbow;

the base mount having a lower flat mounting surface with at least one elongated slot opening in the base mount for allowing adjustment of the base amount on the crossbow to position the fiber optic sight;

a vertical second base mount connected to and extending upwardly from the base mount;

a bracket fastener attached to the vertical base mount and having an upper clamping surface;

a second horizontal bracket fastener is positioned below the first horizontal bracket panel and including a lower clamping surface;

an adjuster screw clamping the two bracket fasteners together so that they are able to clamp onto the graduated slide scale and hold it in an adjusted position with the adjusting screw to aligns the adjustable fiber optic sight for aiming the crossbow; and a peep sight for mounting on a crossbow sight bridge for sighting on the sighting pins.

* * * * *